United States Patent [19]

Abe et al.

[11] Patent Number: 5,021,809

[45] Date of Patent: Jun. 4, 1991

[54] INK JET RECORDING DEVICE WITH PRESSURE-FLUCTUATION ABSORPTION

[75] Inventors: Tsutomu Abe, Isehara; Isao Ebisawa; Kenjiro Watanabe, both of Tokyo; Seiichiro Karita, Yokohama, all of Japan

[73] Assignee: Canon Kabushiki Kaisha, Tokyo, Japan

[21] Appl. No.: 418,961

[22] Filed: Oct. 10, 1989

Related U.S. Application Data

[63] Continuation of Ser. No. 122,680, Nov. 19, 1987, abandoned.

[30] Foreign Application Priority Data

Nov. 19, 1986 [JP] Japan ..... 61-275808

[51] Int. Cl.[5] ..... B41J 2/055

[52] U.S. Cl. ..... 346/140 R

[58] Field of Search ..... 346/140

[56] References Cited

U.S. PATENT DOCUMENTS

| | | | |
|---|---|---|---|
| 3,083,689 | 4/1963 | Hegener | 346/140 |
| 4,057,807 | 11/1977 | Fischbeck et al. . | |
| 4,115,789 | 9/1978 | Fischbeck . | |
| 4,124,853 | 11/1978 | Kattner | 346/140 |
| 4,158,847 | 6/1979 | Heinzl | 346/140 |
| 4,223,323 | 9/1980 | Bader | 346/140 |
| 4,338,611 | 7/1982 | Eida | 346/75 |
| 4,347,524 | 8/1982 | Engel | 346/140 |
| 4,429,320 | 1/1984 | Hattori | 346/140 |
| 4,463,362 | 7/1984 | Thomas | 346/140 |
| 4,484,202 | 11/1984 | Sayko | 346/140 |
| 4,571,599 | 2/1986 | Rezanka | 346/140 |
| 4,596,994 | 6/1986 | Matsuda | 346/140 |
| 4,630,072 | 12/1986 | Scardovi | 346/140 |
| 4,675,693 | 6/1987 | Yano et al. . | |

FOREIGN PATENT DOCUMENTS

| | | |
|---|---|---|
| 0110499 | 6/1984 | European Pat. Off. . |
| 2700010 | 7/1977 | Fed. Rep. of Germany . |
| 3402683 | 8/1984 | Fed. Rep. of Germany . |

*Primary Examiner*—Joseph W. Hartary

*Attorney, Agent, or Firm*—Fitzpatrick, Cella, Harper & Scinto

[57] ABSTRACT

An ink jet recording head comprises an ink discharging opening, a liquid pathway communicating with the ink discharging opening, a device for generating energy used to discharge ink provided along the liquid pathway, a first liquid chamber communicating with the liquid pathway, a second liquid chamber communicating with the first liquid chamber and provided only on the side of the liquid pathway opposite to the side on which the device for generating energy is provided and a pipe feeds ink to the second liquid chamber. A bag in the second liquid chamber forms a flexible space filled with air for absorbing each pressure fluctuation created in the first liquid chamber by actuation of the energy generating device and for preventing such fluctuation from propagating to the ink feeding pipe.

7 Claims, 4 Drawing Sheets

INK JET RECORDING DEVICE WITH PRESSURE-FLUCTUATION ABSORPTION

This application is a continuation of application Ser. No. 07/122,680 filed Nov. 19, 1987, now abandoned.

BACKGROUND OF THE INVENTION

1. Field of the Invention

This invention relates to an ink jet recording head discharging ink from an ink discharging opening based on recording information, and an ink jet recording device having said ink jet recording head, as well as a method for operating said ink jet recording head.

2. Related Background Art

An ink jet recording device supplies ink to a recording head and discharges ink through an ink discharging opening provided at said recording head based on recording information, thereby effecting recording using ink droplets flying from the ink discharging opening toward an recording medium such as a recording sheet.

As an example of the ink jet recording head, there has been used structure in which a plurality of ink discharging openings communicate with one common liquid chamber. FIG. 4 depicts schematically such an example of the ink jet recording head of the prior art.

In FIG. 4, on an ink discharging surface (at the front end of the recording head 1 in this drawing) are formed a plurality of ink discharging openings 2 according to a predetermined arrangement, and liquid pathways 3 extended from the respective ink discharging openings communicate with a liquid chamber 4 formed internally of the head 1. In FIG. 4, however, only some of the liquid pathways arranged at or near the ends of opening array are shown. Ink from the ink feeding source (for example, an ink tank of cartridge type that is not shown) is fed through a feeding pipe 5 to the liquid chamber 4. In the example shown in FIG. 4, the feeding pipe 5 is connected through a L-joint to the liquid chamber forming member 4.

The recording head described above has its respeotive constituting members assembled on a base plate 7.

FIGS. 5(A), 5(B) and 5(C) are schematic sectional drawings for showing the mechanism of ink discharging in the head 1.

In FIG. 5(A), ink 10 fed through the feeding pipe 5 is filled in the liquid chamber 4 and the respective liquid pathways 3, and on the wall surfaces of the respective liquid pathways 3 are provided heaters 11 as means for generating energy utilized to discharge ink 10. When signals are applied from a driving system not shown on the heaters 11 of the respective liquid pathways 3, an abrupt pressure change preferably accompanied by bubble formation causes ink 10 to discharge from the ink discharging openings 2.

The numeral 13 shows the meniscus of ink at the discharging opening 2.

In this case, the pressure wave 14 generated is propagated not only in the direction toward the ink discharging opening 2 but also in the direction toward the common liquid chamber as indicated in FIG. 5(B).

Particularly, when ink is discharged simultaneously from a number of liquid pathways 3, the pressure wave 14 sometimes cannot be disregarded. More specifically, when a pressure wave denoted by the numeral 14 is generated as in FIG. 5(B), ink 10 not only in the liquid chamber 4 but also in the feeding pipe 5 is affected thereby, whereby the force in the direction opposite to the ink feeding direction will act on the ink 10. As a result, feeding of ink is obstructed to slow the refilling (supplementing) speed of ink 10.

As a consequence, a next pulse signal is applied to the heater 11 under an after incomplete refilling to initiate next ink discharging, whereby there sometimes ensues a problem such that poor ink discharging occurs such reduced ink dot diameter or retarded ink discharging speed.

Such a problem is liable to occur particularly in the ink jet recording head of high speed printing type or large ink dot discharging type, and it has been an obstacle in acceleration of printing speed or formation of multi-nozzle head.

To solve this problem by absorbing the pressure change in a liquid chamber, air space may be provided in the liquid chamber as described in, for example, U.S. Pat. No. 4,158,874. In this constitution, however, a larger height of liquid chamber shall be required, thus resulting in enlargement of the recording head. Further, since the height of the liquid chamber becomes greater than the height of the discharging opening bearing portion, there is brought about a problem such that a user can not see printed letters immediately after ink discharging.

On the other hand, in FIG. 2 of U.S. Pat. No. 4,596,994, it is disclosed that another liquid chamber 206 is provided as communicating with a common liquid chamber 205. However, in this patent document, the liquid chamber 206 is not disclosed as containing space formed therein, and is not necessarily considered to have a pressure wave absorbing function (damper effect) since the liquid chamber 206 is provided at the side having an energy generating means.

SUMMARY OF THE INVENTION

An object of the present invention is to provide an ink jet recording head, and a recording device having said recording head, as well as a method for operating said recording head capable of solving such problems as described above of the prior art and affording stable ink refilling even in the case of simultaneous ink discharging through a number of ink discharging openings to eliminate poor ink discharging by absorbing the pressure wave progressing oppositely to the ink feeding direction.

According to an aspect of the present invention, there is provided an ink jet recording head which comprises an ink discharging opening, a liquid pathway communicating with said ink discharging opening, means for generating energy used to discharge ink provided along said liquid pathway, a first liquid chamber communicating with said liquid pathway, a second liquid chamber communicating with said first liquid chamber and provided only on the side of said liquid pathway opposite to the side on which said means for generating energy is provided and a pipe for feeding ink to said second liquid chamber.

According to still another aspect of the present invention, there is provided a method for working an ink jet recording head comprising arranging on a carriage an ink jet recording head which comprises an ink discharging opening, a liquid pathway communicating said liquid ink discharging opening, means for generating energy used to discharge ink provided along said liquid pathway, a first liquid chamber communicating with said liquid pathway, a second liquid chamber communicating with said first liquid chamber and provided only on the side of said liquid pathway opposite to the side on which said means for feeding ink to said second liquid chamber in such a manner that said first liquid chamber and said second liquid chamber are horizontally adjacent to each other;

filling the upper space of said second liquid chamber with air; and applying signal to said means for generating energy thereby effecting recording.

DESCRIPTION OF THE PREFERRED EMBODIMENTS

The ink jet recording head of the present invention comprises an ink discharging opening, a liquid pathway communicating with said ink discharging opening, means for generating energy utilized to discharge ink provided along said liquid pathway and a first liquid chamber communicating with said liquid pathway. Also, the ink jet recording head of the present invention comprises a second liquid chamber communicating with said first liquid chamber so as to have a damping function and provided on the opposite side of said liquid pathway to the side on which said energy generating means is provided in a manner such that said first and second chambers are adjacent to each other. Further, to said second liquid chamber, a pipe for feeding ink from an ink feeding source is connected.

On the other hand, the ink jet recording device of the present invention comprises an ink jet recording head of the present invention as described above.

As an energy generating means used for the ink jet recording head of the present invention, there may be included an electrothermal converting element, an electromechanical converting element such as piezo element, etc. In particular, the effect of the present invention is significantly exhibited in the case of using an electrothermal element.

The ink discharging opening of the ink jet recording head of the present invention may be provided in a manner such that the direction of ink discharging is generally perpendicular to the direction of ink flow within the liquid pathway, or otherwise in a manner such that the direction of ink discharging is oriented to neither the parallel nor the parpendicular directions to the direction of ink flow within the liquid pathway.

In case that a plurality of ink discharging openings are provided in the ink jet recording head of the present invention, the liquid pathway communicating with the plural number of ink discharging openings may be provided in the plural number so as to correspond to the respective ink discharging openings or solely so as to be in common with the whole ink discharging openings.

In the ink jet recording head of the present invention, since the second liquid chamber is provided as described above, pressure wave progressing toward the direction opposite to the direction of ink feeding, in particular pressure wave progressing toward the direction opposite to the side on which the energy generating means is provided, is effectively absorbed.

Accordingly to the present invention, an ink jet recording head very stable in ink refilling and very good ink discharging can be obtained.

Figure 1:
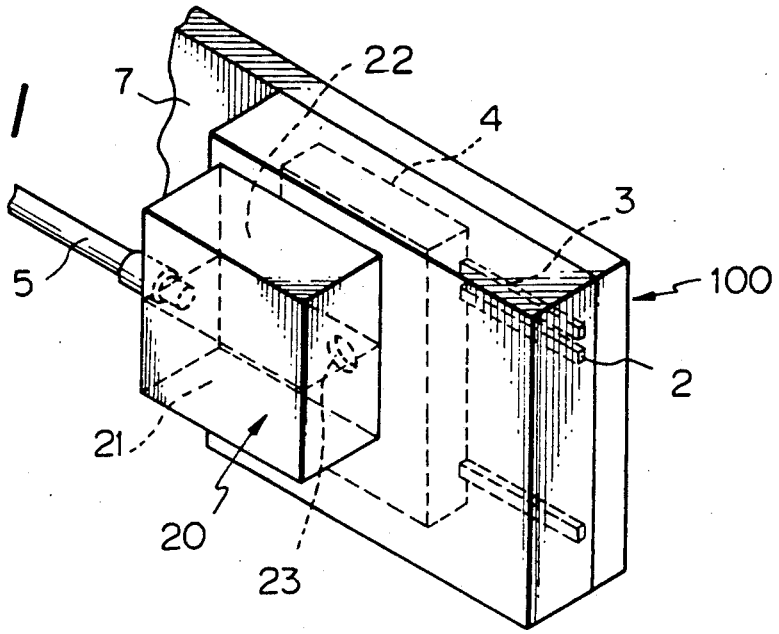
FIG. 1 is a schematic perspective view showing the pertinent portion of an example of the ink jet recording head of the present invention.
Figure 2A:
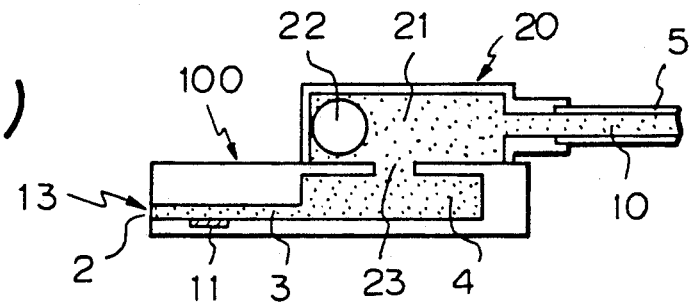
FIGS. 2(A), 2(B) and 2(C) are schematic sectional views for showing the mechanism of ink discharging in the ink jet recording head of FIG. 3.
Figure 2B:
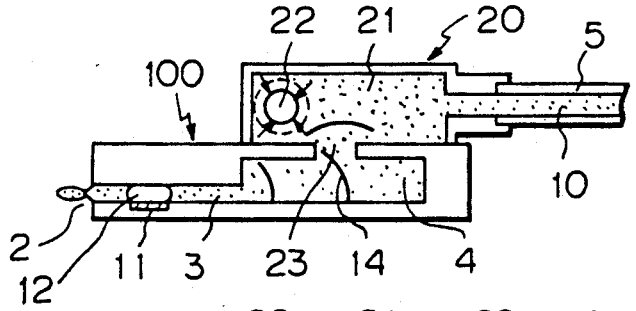
Figure 2C:
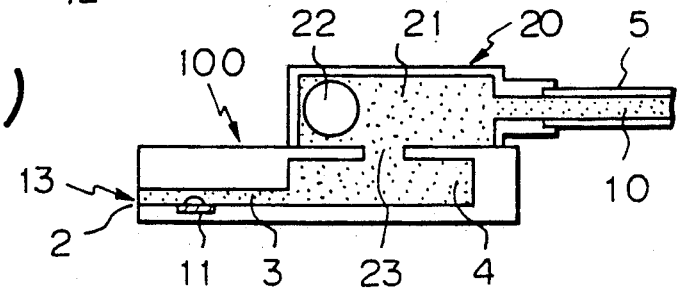
Figure 3:
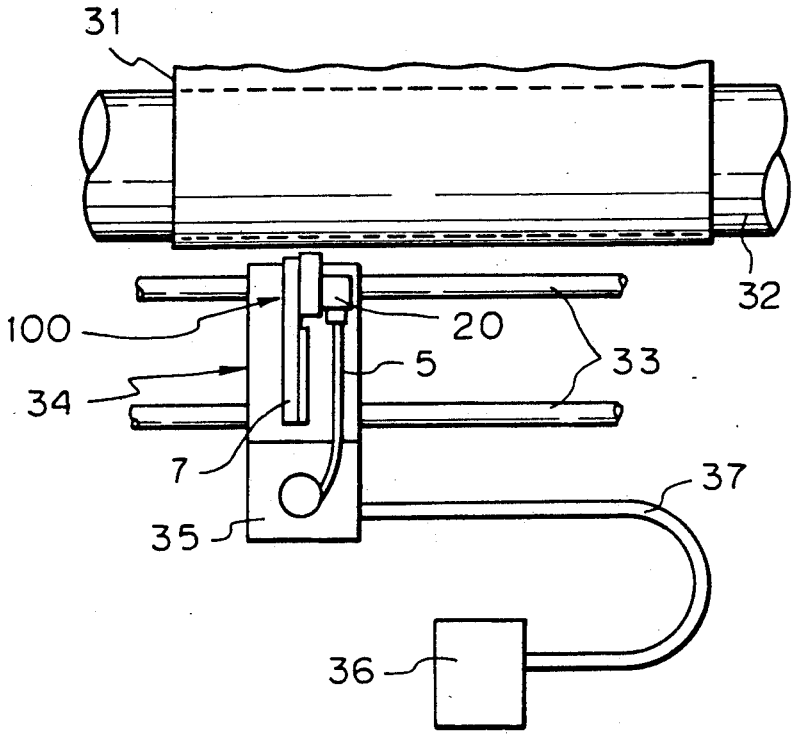
FIG. 3 is a schematic plan view of the pertinent portion of an ink jet recording device of the serial type of the present invention.

Referring now to FIGS. 1–3, the present invention is described in detail.

FIG. 1 is a schematic perspective view showing the pertinent portion of an example of the ink jet recording head of the present invention.

As shown in FIG. 1, in the recording head 100, a plurality of ink discharging openings 2 communicate respectively through liquid pathways 3 to a common liquid chamber 4. In FIG. 1, however, only some of the plural liquid pathways positioned at or near the ends of pathway array are depicted. There is also provided a second chamber 20 having a damping function located adjacent to said common liquid chamber 4, and ink 10 fed from the ink feeding source not shown through the feeding pipe 5 is fed via the above second chamber 20 into the above liquid chamber 4.

In the above second chamber 20 are formed a space 21 filled with ink 10 and a space 22 filled with air, and the space 21 filled with ink 10 communicates through a hole 23 provided beneath the ink liquid surface to the above liquid chamber 4.

Figure 4:
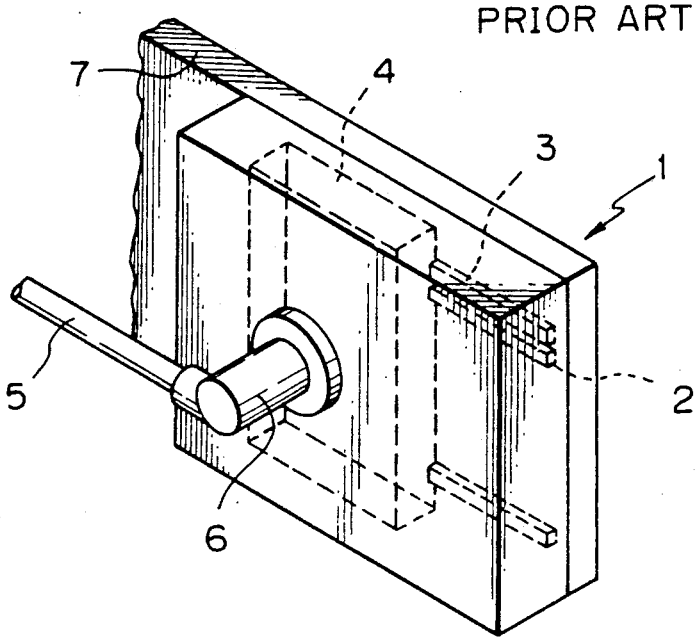
Fig. 4 PRIOR ART
FIG. 4 is a schematic perspective view of the pertinent portion of an ink jet recording head of the prior art.
Figure 5A:
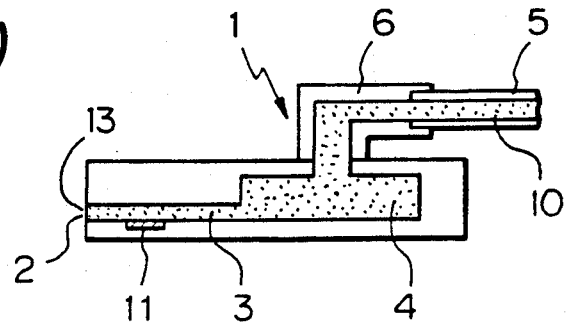
Fig. 5(A) PRIOR ART
FIGS. 5(A), 5(B) and 5(C) are schematic sectional views for showing the mechanism of ink discharging in the ink jet recording head of FIG. 4.
Figure 5B:
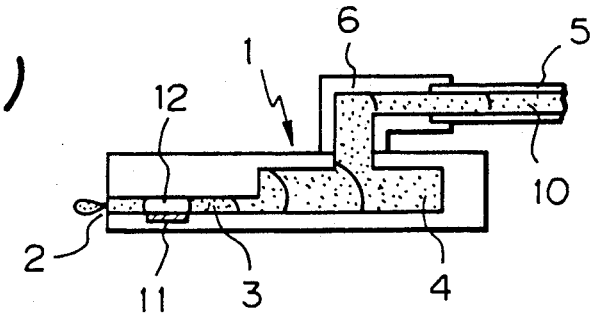
Fig. 5(B) PRIOR ART
Figure 5C:
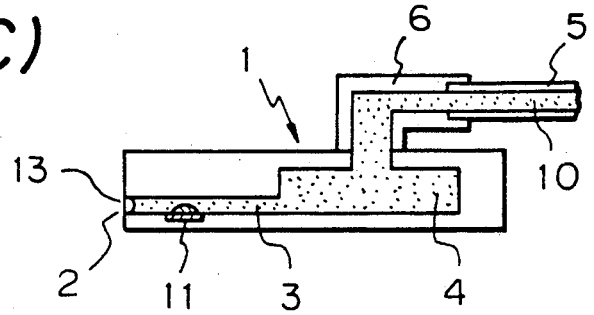
Fig. 5(C) PRIOR ART

Other portions of this example are substantially the same as in the case of the ink jet recording head structure of the prior art shown in FIG. 4, and the respective corresponding parts are denoted by the same numerals and detailed description thereof is omitted.

Thus, since the second chamber 20 is provided adjacent to the liquid chamber 4, the pressure wave progressing toward the opposite direction to the ink feeding direction generated by bubbling, etc., during ink discharging is absorbed by the second chamber 20, whereby influence of the pressure wave onto the ink feeding route including the feeding pipe 5, etc. can be alleviated or avoided to make refilling of ink smooth and ensure stable recording of high quality.

FIGS. 2(A), 2(B) and 2(C) are schematic sectional views showing the mechanism of ink discharging in the ink jet recording head 100 in FIG. 1.

In FIGS. 2(A) through 2(C), the space 22 filled with air in the second chamber 20 is shown in a circular form for illustrating convenience and the size of volume of the space 22 filled with air (space above the ink liquid surface) is shown by its area.

Among FIGS. 2(A) through 2(C), FIG. 2(A) indicates the initial state and FIG. 2(B) the state when bubbles 12 are generated by application of driving (discharging) signals to the heater 11.

During recording, ink 10 is discharged as liquid droplets from the ink discharging openings 2 and at the same time the pressure wave 14 is also transmitted into the liquid chamber 4. This is the same as in the case of the ink jet recording head structure of the prior art shown in FIG. 4 and FIGS. 5(A) through 5(C).

However, in this example, since the second chamber 20 having the space 21 filled with ink and the space 22 filled with air communicates adjacently with the liquid chamber 4, the space 22 filled with air in said second chamber 20 is compressed as in FIG. 2(B) by the pressure wave 14 transmitted through the liquid chamber 4, whereby the pressure is absorbed and further pressure transmission of said pressure, namely pressure transmission into the feeding pipe 5 is reduced or eliminated.

Accordingly, there will be no action pressure in the opposite direction to the ink feeding direction on ink within the ink feeding route including the feeding pipe 5, and the next refilling of ink 10 can be performed smoothly without delay.

As a consequence, when a next signal is applied to the heater 11, the ink 10 is surely refilled as shown in FIG. 2(C) and constantly stable refilling can be effected even in the case of simultaneous ink discharging through a number of ink discharging openings 2, whereby it is rendered possible to perform stable printing of high quality.

In the preferred example described above, a space 22 filled with air was provided in a second chamber and diffusion of pressure was prevented by the pressure absorbing action of this space filled with air, but the structure of the second chamber is not limited to this, but, for example, it may be a chamber which has a flexible wall such as bag expanding and contracting depending on the ink amount.

Further, when the present invention is applied for an ink jet recording device of the so called serial type, there can be also obtained the effect that the pressure fluctuation within the ink feeding pipe occurring by acceleration of deceleration upon direction change of the carriage can be absorbed by the above second chamber 20.

FIG. 3 is a schematic plan view showing the pertinent portion of the ink jet recording device of the serial type in which the present invention is practiced.

In FIG. 3, in front of the platen 32 which backs up the recording sheet 31 are provided guide shafts 33, in parallel thereto, and a recording head 100 is mounted on the carriage 34 which moves along said guide shafts.

The recording head 100 has substantially the same constitution as in the ink jet recording head of FIG. 1, and a head element having a plurality of ink discharging openings 2 and a liquid chamber 4 is mounted on a base plate 7 fixed on a carriage 34, and a second liquid chamber 20 is provided adjacent to said liquid chamber 4.

On the above carriage 34 is mounted a sub-tank 35, and said sub-tank 35 and the above second chamber 20 are connected with the above feeding pipe 5.

Also, the ink feeding source (main tank for ink) 36 is provided on the main body side of the recording device, and said ink feeding source 36 and the above sub-tank 35 are connected by a flexible feeding tube 37. The feeding tube 37 is constituted of a tube having a length and flexibility which can be freely flexed following the movement of the carriage 34.

In the ink jet recording device of such serial type, when the carriage 34 moves along the guide shafts 33, pressure fluctuation occurs within the ink feeding system to the recording head 100 by acceleration and deceleration, etc., during direction change on both sides of the device of said carriage. This pressure fluctuation, which causes poor ink discharging, should be suppressed as much as possible.

Accordingly, in the prior art, although the pressure fluctuation occurring in the feeding tube 37 has been absorbed within the sub-tank 35, for the pressure fluctuation generated within the feeding pipe 5, there have been employed the method in which the pressure is attenuated by utilizing the flow resistance by making the pipeline of said feeding pipe 5 complicated and the method in which piping is made within the plane vertical to the carriage movement direction so that no pressure fluctuation component in the running direction of the carriage 34 may occur.

In the ink jet recording head of the present invention, as described above, since a second liquid chamber is provided as communicating adjacently with the liquid chamber 4, it becomes possible to absorb also the pressure fluctuation generated within the feeding pipe 5 during the carriage turn, and therefore, it is not necessary to employ a complicated constitution as described above for piping of the feeding pipe 5, whereby the degree of freedom in design could be improved.

Figure 6:
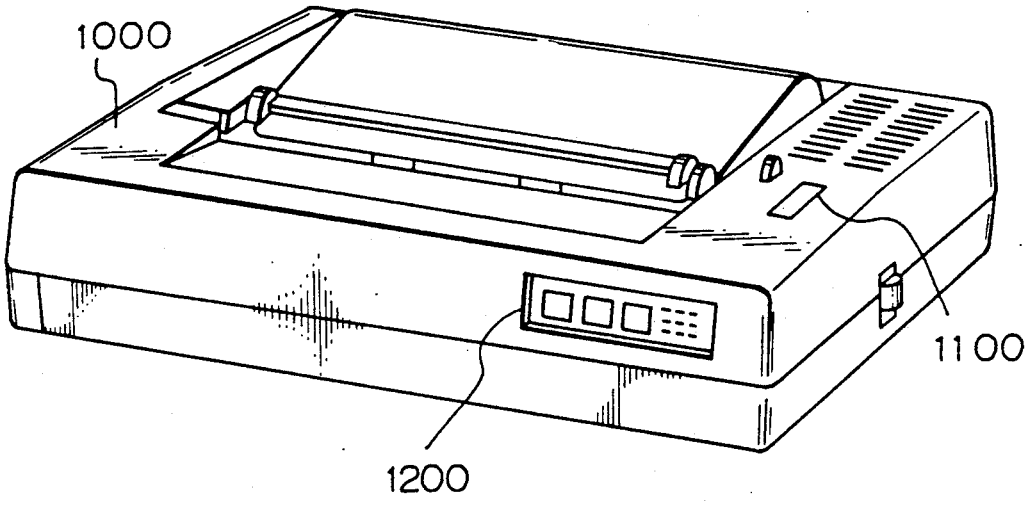
FIG. 6 is a schematic perspective view showing the external appearance of an ink jet recording head of the present invention.

FIG. 6 is a schematic perspective view showing the external appearance of the ink jet recording device of the present invention. In FIG. 6, numeral 1000 denotes the main body of device, numeral 1100 a power switch, and numeral 1200 an operation panel.

As is apparent from the above description, according to the present invention, the pressure wave progressing oppositely to the ink feeding direction generated in the ink feeding system during ink discharging can be absorbed and stable refilling of ink can be performed smoothly even when ink is discharged simultaneously from a number of discharging openings. Besides, in the case of an ink jet recording device of the serial type, even the pressure fluctuation during carriage turn can be effectively absorbed to ensure stable ink discharging, and there are provided an ink jet recording head, and an ink jet recording device having the ink jet recording head, as well as a method for working the ink jet recording head, which can improve degree of freedom in design without restriction in piping of the feeding pipe.

In particular, according to the present invention, since the second liquid chamber is provided on the side of the liquid pathway opposite to the side on which the energy generating means is provided, it is possible to absorb effectively pressure wave generated by the energy generating means and progressing oppositely to the ink feeding direction and further to produce an ink jet recording head quite easily.

We claim:

1. An ink jet recording apparatus comprising:

an ink source;

an ink feeding path for feeding ink from said ink source;

a movable carriage; and an ink jet recording head mounted on said carriage and having at least one ink discharging opening, an ink pathway communicating with each said ink discharging opening, energy generating means disposed along a side wall of each said ink pathway and being actuatable for generating energy used to discharge from said opening ink in said ink pathway, a first ink chamber for containing ink and supplying it to said ink pathway, said ink chamber having a first wall and a second wall, said first wall substantially coplanar with the ink pathway side wall on which said energy generating means is disposed, and said second wall opposite said first wall, and a second ink chamber for containing ink and supplying it to said first ink chamber, wherein said second ink chamber is in communication with said ink feeding path and shares said second wall with said first ink chamber and communicates with said first ink chamber through an opening in said second wall, wherein said second ink chamber has therein a flexible space filled with air for absorbing pressure fluctuations created in said first ink chamber by actuation of said energy generating means and by movement of said carriage, thereby preventing such fluctuations from propagating to said ink feeding path.

2. An ink jet recording apparatus according to claim 1, wherein said energy generating means is an electrothermal converting element.

3. An ink jet recording apparatus according to claim 1, wherein said energy generating means is an electromechanical converting element.

4. An ink jet recording apparatus according to claim 1, wherein said ink discharging opening is oriented so as to discharge ink toward generally the same direction as that of ink feeding within said ink pathway.

5. An ink jet recording apparatus according to claim 1, wherein said ink discharging opening is oriented so as to discharge ink generally in the direction perpendicular to the direction of ink feeding within said ink pathway.

6. An ink jet recording apparatus according to claim 1, wherein a plural number of said ink discharging openings are provided.

7. An ink jet recording apparatus according to claim 1, further comprising a plurality of pairs of said ink discharging openings, a plurality of said ink supply paths communicating with said openings, and a plurality of said energy generating means, wherein said first ink chamber commonly communicates with said plurality of ink supply paths.

* * * * *

UNITED STATES PATENT AND TRADEMARK OFFICE

CERTIFICATE OF CORRECTION

PATENT NO. : 5,021,809

DATED : June 4, 1991

INVENTOR(S) : TSUTOMU ABE, ET AL.

It is certified that error appears in the above-identified patent and that said Letters Patent is hereby corrected as shown below:

COLUMN 1

Line 21, "an" should read --a--.
Line 39, "a" should read --an--.
Line 41, "respeo-" should read --respec- --.

COLUMN 2

Line 5, "under an" should be deleted.
Line 7, "such" (second occurrence) should read --such as--
.

COLUMN 3

Line 17, "FIG. 3;" should read --FIG. 1;--.
Line 23, "and" should be deleted.
Line 26, "FIG. 4." should read --FIG. 4; and--.
Line 64, "parpendicular" should read --perpendicular--.

COLUMN 4

Line 12, "Accordingly" should read --According--.

--

UNITED STATES PATENT AND TRADEMARK OFFICE

CERTIFICATE OF CORRECTION

PATENT NO. : 5,021,809

DATED : June 4, 1991

INVENTOR(S) : TSUTOMU ABE, ET AL.

It is certified that error appears in the above-identified patent and that said Letters Patent is hereby corrected as shown below:

COLUMN 5

Line 34, "of" should read --or--.

Signed and Sealed this

Sixteenth Day of February, 1993

*Attest:*

STEPHEN G. KUNIN

*Attesting Officer*

*Acting Commissioner of Patents and Trademarks*